US007728210B2

(12) United States Patent
Thidell

(10) Patent No.: US 7,728,210 B2
(45) Date of Patent: Jun. 1, 2010

(54) DEVICE FOR STRING INSTRUMENTS

(76) Inventor: Anders Thidell, Keramikvagen 6, Sodertalje (SE) S-151 55

( * ) Notice: Subject to any disclaimer, the term of this patent is extended or adjusted under 35 U.S.C. 154(b) by 0 days.

(21) Appl. No.: 12/295,086

(22) PCT Filed: Apr. 2, 2007

(86) PCT No.: PCT/SE2007/050205

§ 371 (c)(1),
(2), (4) Date: Sep. 29, 2008

(87) PCT Pub. No.: WO2007/114782

PCT Pub. Date: Oct. 11, 2007

(65) Prior Publication Data

US 2009/0114076 A1 May 7, 2009

(30) Foreign Application Priority Data

Apr. 6, 2006 (SE) ..... 0600783

(51) Int. Cl.
*G10D 3/06* (2006.01)

(52) U.S. Cl. ..... 84/314 R

(58) Field of Classification Search ..... 84/314 R, 84/312 R

See application file for complete search history.

(56) References Cited

U.S. PATENT DOCUMENTS

| | | | | |
|---|---|---|---|---|
| 4,132,143 | A | 1/1979 | Stone | |
| 4,137,813 | A | 2/1979 | Stone et al. | |
| 5,760,322 | A | 6/1998 | Ward et al. | |
| 6,825,406 | B2 | 11/2004 | Thidell | |
| 2003/0140765 | A1 * | 7/2003 | Herman | 84/314 R |
| 2004/0173080 | A1 * | 9/2004 | Pye et al. | 84/314 R |

FOREIGN PATENT DOCUMENTS

| | | |
|---|---|---|
| SE | 522974 | 3/2004 |

OTHER PUBLICATIONS

International Search Report dated Jul. 10, 2007 for International Application No. PCT/SE2007/050205.

* cited by examiner

*Primary Examiner*—Kimberly R Lockett
(74) *Attorney, Agent, or Firm*—Frost Brown Todd LLC

(57) ABSTRACT

A device for string instruments comprising a fretboard with a plurality of frets, arranged at a distance from each other along the lengthwise direction of the fretboard and running transversely across the fretboard. Over the fretboard, at right angles to and above the frets, are lengthwise tensioned strings (8), intended to be set in oscillation for tone generation, where the lengths of the oscillating parts of the strings are variable for variation of pitch by pressing the strings against selectable frets. At least some of the frets include a straight fret segment (18) located beneath at least one of the strings, which fret segment is displaced lengthwise along the strings in relation to other segments of the fret in question. In the manufacturing procedure for the device, values are measured for the position on the fretboard for contact points between string (8) and fret for correct intonation, whereupon corresponding fret slots with the determined said measured values for contact point positions on the fretboard, are individually milled across the fretboard, whereafter a prototype substance consisting of relatively soft material is pressed in to the slot, so a fret prototype with a corresponding shape is produced. A casting mould is made around said prototype, whereupon a fret is cast in the mould, which fret is thereafter inserted in the fret slot. Strings for musical instruments comprising a glass-metal material have also been described.

16 Claims, 2 Drawing Sheets

DEVICE FOR STRING INSTRUMENTS

Figure 1:
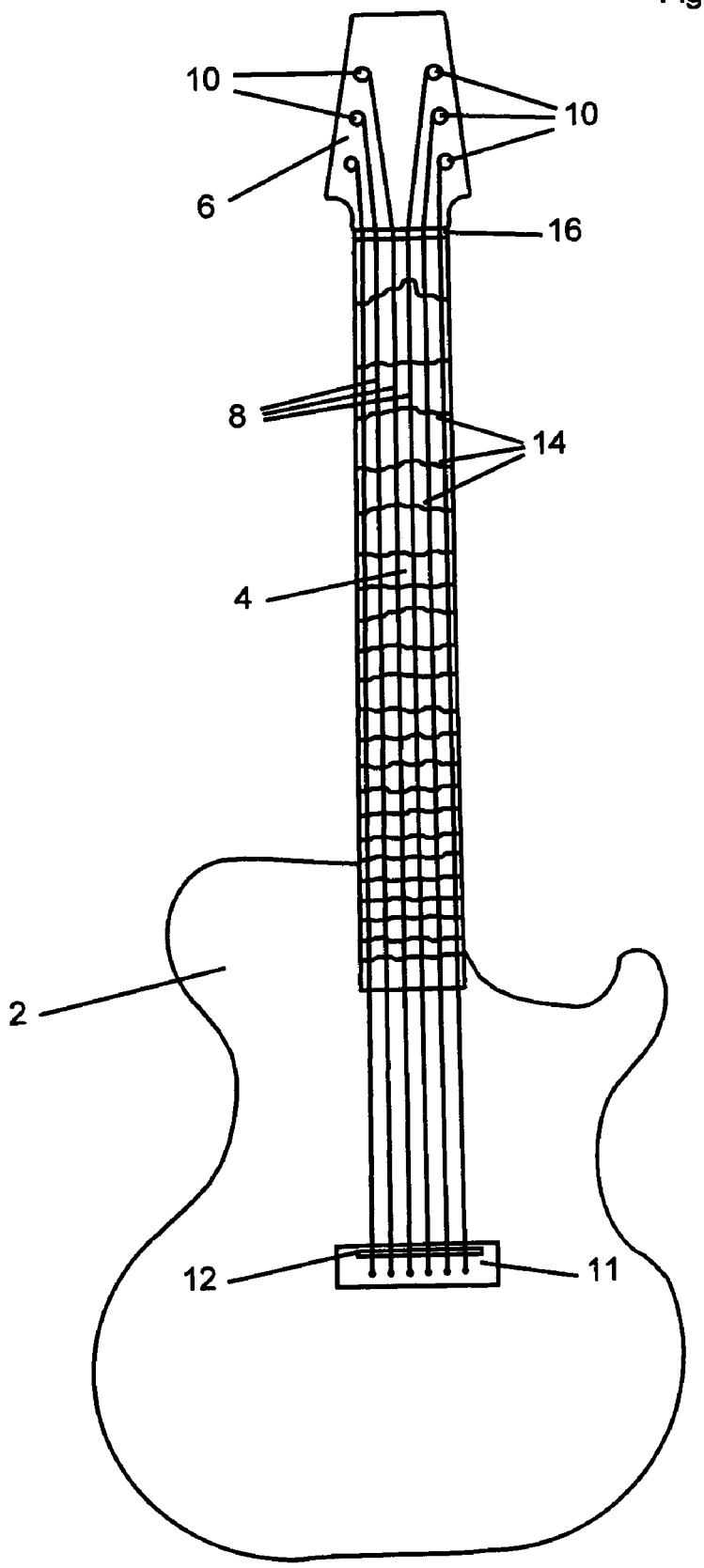

The present invention relates to a device for string instruments, comprising a fretboard with a plurality of frets, arranged at a distance from each other along the lengthwise dimension of the fretboard and running transversely across the fretboard. Over the fretboard, at right angles to and above the frets, are lengthwise tensioned strings, intended to be set in oscillation for tone generation, where the lengths of the oscillating parts of the strings are variable for variation of pitch by pressing the strings against selectable frets. The invention also relates to a procedure for manufacturing such a device.

On string instruments of the type described above, difficulties exist with correct intonation over different parts of the fretboard. It is possible to improve the intonation by applying more frets over for example a guitar's fretboard. Such a solution would, however, demand the laborious acquisition of a new playing technique, which would not be attractive to musicians.

Another method for achieving improvement of intonation of note intervals on instruments of the type described is to design the instrument with frets with a curved shape across the fretboard, see U.S. Pat. No. 5,760,322 and SE 522 974. U.S. Pat. No. 5,760,322 describes a string instrument on which two notes are corrected by designing two frets with a bend pointing towards the head of the instrument under each respective string, in this way lowering two notes. This will lead to an improvement of the intonation of certain intervals, and thereby certain chords, while intonation of other close intervals which use the same note, and thereby other chords, deteriorates. Neither can other intonation problems on for example guitars, which relate to the fact that the same note can be played at different places on different strings on the instrument, be solved with this technique.

It has been shown that while playing, for example a guitar, when musicians press the string or strings to the fretboard with their fingers, they almost always displace the strings sideways to some degree. With the earlier known technique according to the above mentioned document, where the fret's bend or curve is centred around the string's rest point over the fret, any displacement along the string's contact point with the fret will lead to an exaggerated change of the pitch, which itself leads to impurities.

The purpose of the present invention is to eliminate this problem.

This purpose will be achieved with a device of the type mentioned in the introduction with characteristics according to claim 1.

Designing the frets with straight fret segments beneath the strings, where the fret segments are displaced lengthwise along the strings in relation to other segments of the fret concerned, renders the possibility of correcting note intervals, while at the same time the note that results from a string being pressed against a fret segment remains practically unchanged, in other words any pitch change will be minimal, even if the string's contact spot with the fret segment is displaced sideways while playing.

According to advantageous applications of the device according to the invention, the straight fret segment and relevant string are centred in relation to each other, so that the string in its rest position is located essentially over the centre of the fret segment, and the straight fret segment extends on each side of the string's rest point, preferably to the centre of the gap to the adjacent string. In this way a slight displacement of the string's contact point with the fret segment, in either direction along the fret segment, will not produce any substantial change of pitch, and by letting the straight fret segments extend essentially to the centres of the gaps to the adjacent strings, a design which allows a maximal displacement of the string contact position with retained pitch is achieved.

According to yet another advantageous embodiment of the device according to the invention, each fret includes a straight fret segment, centred beneath each above positioned string. In this way an adjustment of the pitch of each and every note over the entire fretboard can be achieved as necessary, and the adjustment can consist of either a raising or lowering of the notes.

The invention also refers to a fretboard for a neck for a guitar, mandolin, mandola, banjo, bass guitar or similar string instrument, including a device as described above, also to such a neck and a string instrument containing such a neck. On instruments with glued in necks the fretboard can be exchanged by removing the old fretboard from the neck with a cutter, whereupon a new fretboard can be glued in place. To change the existing neck on a conventional string instrument of the above mentioned type with a neck according to the invention is in normal conditions a comparatively simple operation, and the result will be an instrument with considerably improved intonation.

According to yet other embodiments of the device according to the invention, the frets are arranged so that nineteen notes are accessible within the octave, or, better still, that thirty-one notes are accessible within the octave. Nineteen notes within the octave represents a considerable improvement in intonation in comparison to the equal temperament in general use today which has twelve notes within the octave. Thirty-one notes within the octave achieve the perfect balance between intonation and practical playability.

The invention also refers to a procedure according to claim 13 for manufacture of the device according to the invention.

According to an advantageous embodiment of the procedure according to the invention the frets are manufactured of CuNi. This is a relatively hard alloy with a low coefficient of friction, which leads to that the material, and thereby the frets, wears slowly.

The invention also relates to strings for string instruments comprised of a glass-metal material. These strings have very long sustain, and due to this material's unique combination of strength and flexibility these strings show superior durability and intonation characteristics.

According to an advantageous embodiment of the string according to the invention the core has a round or hexagonal cross section. The hexagonal cross section is particularly advantageous on wound strings, because the winding is then held securely in place on the core, without any risk of slippage, because the core grips the winding more efficiently.

Figure 2:
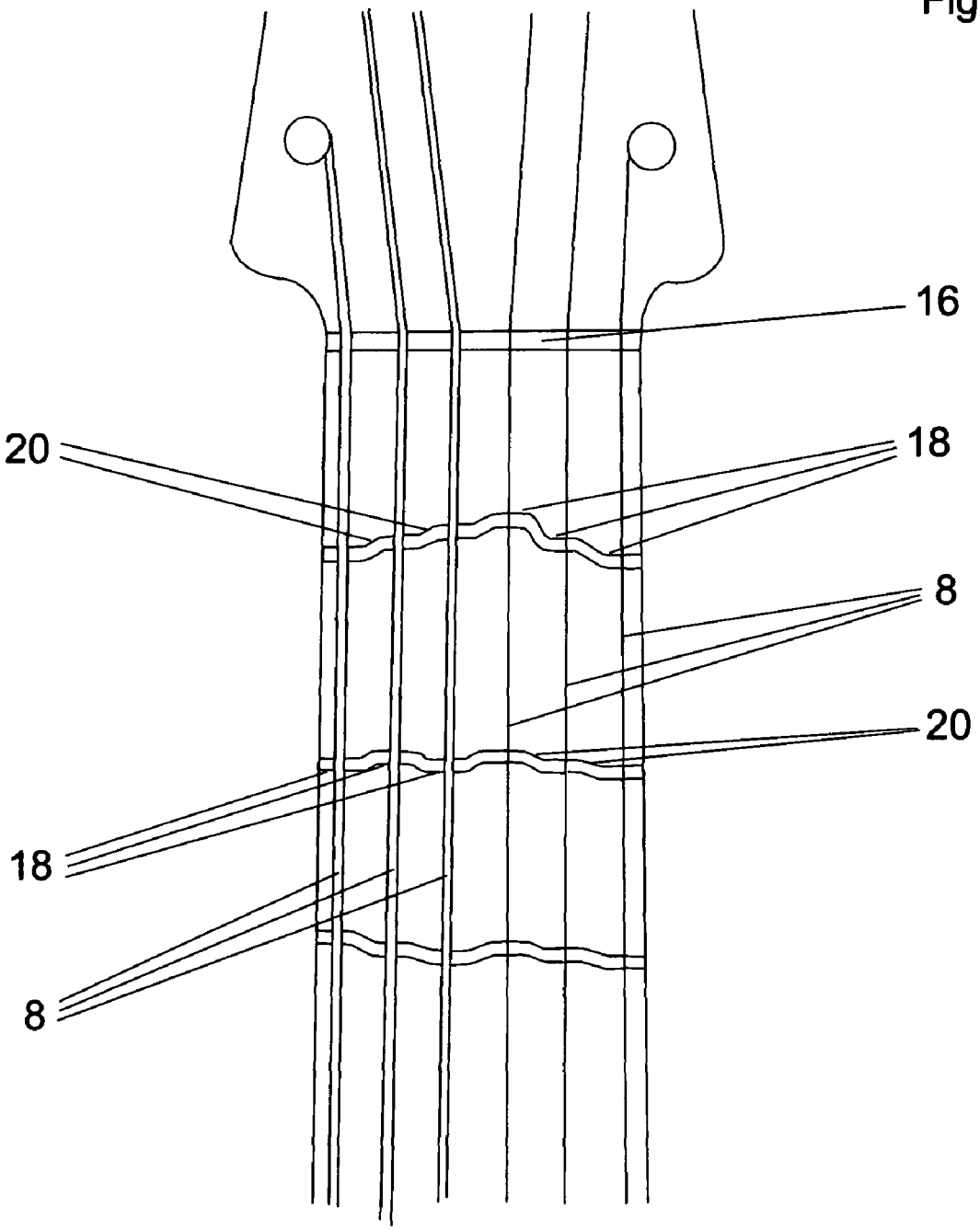

To explain the invention more closely, chosen embodiments of the invention will now be described in more detail, with references to the attached drawings, where FIG. 1 shows a schematic illustration of the front of an example of a string instrument in the shape of a guitar, with the device according to the invention, and FIG. 2 shows a part of the neck closest to the peghead for a string instrument of the type described in larger scale, which neck is provided with the device according to the invention.

FIG. 1 shows an example of a string instrument, in the shape of a guitar, with the device according to the invention, The instrument comprises a body 2 and an oblong neck 4 with a peghead 6. Strings 8 are tensioned between tuning screws 10 at the peghead 6, over the front of and lengthwise along the neck 4, and a stringholder 11 at the bridge 12 on the body 2.

The neck 4 is designed with a fretboard, which at the upper area of the neck 4 ends with a nut 16, over which the strings 8 extend. The fretboard shows transverse frets 14, which define the length of the oscillating segment of the string 8 between the fret 14, against which the string 8 is temporarily pressed by the player's finger, and the bridge 12.

The instrument is tuned with the tuning screws 10 by increasing or decreasing the tension on the strings 8.

The Equal temperament in general use in western music, which divides the octave into twelve equal semitones, is a compromise which leads to impure intonation. One way to reduce this inconvenience is to design the frets 14 curved in a suitable way. The frets 14 could for example be curved so that all thirds on the instrument will be pure.

With the device according to the invention every fret 14 is comprised of straight fret segments 18 within the part of each fret which is crossed by a string 8, see in particular FIG. 2. These fret segments 18 extend at right angles to the lengthwise direction of the fretboard and are centred with respect to each string's 8 respective rest position, so that the string 8 at its rest position is located over the middle of the straight fret segment 18. It is desirable that the straight fret segment 18 extends as far as possible on each side of the rest position of the string 8, by at least several millimetres, without intruding on the straight fret segment belonging to the nearest adjacent string 8. It is therefore optimal to let the straight fret segment 18 extend essentially to the centre of the gap to the adjacent string.

While playing, when the strings 8 are manipulated by the player's fingers, the strings are seldom pressed straight down against the centre of the straight fret segment 18, but are almost always displaced sideways to some degree, both while chording and while playing melody. If the fret 14 is bent at the area just under the string 8, every tiny sideways displacement will lead to an unnecessarily large, disturbing pitch change with deteriorated intonation as a result. This problem is eliminated by designing the frets 14 with straight fret segments 18 at the area under the strings 8, which fret segment 18 normally being displaced in relation to close by fret segments 18 to attain correct intonation.

The straight fret segments 18 within each fret 14 are themselves connected by curved transitions 20, located at the gaps between the strings 8, so that a continuous fret 14 is achieved, see FIG. 2.

Alternatively, a fret could include several separate straight fret parts, one for each string, displaced lengthwise along the fretboard between themselves, which fret parts are not connected to a continuous fret across the fretboard.

The device according to the invention can advantageously be applied to replacement necks for string instruments of the type described. To change a neck is, at least on certain types of string instruments, a comparatively simple operation. In this way it is rendered possible to implement the invention in a fairly simple way, and thereby at a reasonable cost, even on existing instruments.

To attain optimal intonation possibilities when applying a specific temperament on a string instrument of the type described, all of the note positions on the instrument's fretboard must normally be corrected. Manufacturing of the device according to the invention demands thereby that the note at every note position on the fretboard be monitored, suitably with a microphone, and its frequency measured. This requires sensitive measuring equipment, for example a frequency counter or stroboscope tuner. Auditory monitoring can of course also be used.

After this pitch measurement on the fretboard, coordinates are determined by distance measurements from a suitable reference point, for example the nut, for every note position on the fretboard. For this, miniature frets, which are movable along the fretboard beneath the strings until correct pitch is obtained, are used, whereupon the miniature frets' distances to the reference point are measured. Such so called Dynamic Intonation has been shown to be necessary because a purely mathematical calculation of the placement of the note positions does not take into consideration the dynamic characteristics of the strings, like mass, weight and stiffness at different segments of the strings, which characteristics affect the strings' oscillations.

It has been shown that strings made of so-called glass-metal material or glass-metal alloys have clear advantages in this connection.

Glass-metal alloys exist in several different types. A glass-metal alloy consists of at least three elements with atoms of widely differing sizes, for example iron, tantalum and boron. Further, the atoms do not arrange themselves in a crystalline structure as the material solidifies, but stay in the chaotic condition that prevails in the melt, analagous to the conditions existent in, for example, glass. These strings display a unique combination of strength and flexibility. As a result, the vibration of the string at its first outermost nodal point will reach closer to the depressed fret position, and the string's other outermost nodal point will also reach closer to the string break point at the bridge saddle. Thus the need to compensate the note positions for the stiffness which characterises ordinary metal strings is diminished. Adjustment of the note positions can thus be limited to pitch corrections for the particular temperament in use, to achieve pure intervals.

Glass-metal can be used to construct both wound and unwound strings. The total diameter of wound glass-metal strings can vary from 0.5 mm upwards. The wound string consists of a core wire with round or hexagonal cross section, made of glass-metal. The core wire is overwound with a thinner wire, also made of glass-metal, or of other suitable currently used wire, for example bronze.

Thinner strings, with diameters between 0.1 mm to 0.5 mm, are suitably made as unwound, round glass-metal strings.

Another advantage of glass-metal strings is their long sustain time because of the low energy losses in the material compared to traditional strings made of materials with a crystalline atomic structure. Long sustain is particularly desirable with instruments with the device according to the invention for Dynamic Intonation of the instrument. Long sustain after a chord is played gives players and listeners better opportunity to perceive the advantages of the Dynamic Intonation made possible by the said invention.

It is important to note that all note positions over the entire fretboard must be included in the Dynamic Intonation to achieve a correct result for the proposed temperament. Thus every fret of the device according to the invention comprises straight fret segments at every note position, in other words, for all strings. The note positions, i.e. the straight fret segments relative positions, are adjusted according to requirements, both in a direction towards the nut to lower a note, and in the opposite direction towards the bridge to raise a note.

The size of the displacement of the straight fret segments is normally greatest close to the instrument's head, and can there amount to several millimetres—as much as 20 millimetres, at maximum, on commonly used scale lengths. In other respects the magnitude of the displacements depends upon the temperament being applied, the type of strings as discussed above, and the height of the strings above the fret closest to the instrument's bridge.

After the coordinates for the note positions have been determined, as described above, these coordinate values are fed in to a CNC engraving machine or similar to mill a slot into the fretboard for the fret in question. To obtain adequate precision to the slot design one hundred thirty-two measuring values are used for each slot across a guitar fretboard.

For manufacture of the frets a prototype of each fret is made using a prototyping substance consisting of a relatively soft material, for example Ag, which is pressed down into the milled fret slot. It is important that the material is relatively soft so that it will conform to the fret slot design and exactly adopt its shape.

The fret prototypes made in this way are thereafter removed from the fret slots in the fretboard and casting moulds are produced around the prototypes. Thereafter the frets are cast in these moulds with a harder material, preferably silicon bronze, and are inserted into their respective slots in the fretboard. The silicon bronze material that is used has the advantage of its friction against the strings being lower than the friction against the strings against commonly used frets made of copper/nickel, which leads to decreased wear of both the string and the fret. The suggested silicon bronze material is also preferable for those who suffer from nickel allergies.

Other advantageous materials for casting the frets are the above described glass-metal materials. These materials have excellent sound conduction characteristics because of the minimal energy loss in the material, for that reason they can advantageously be used in practically all parts of an instrument through which oscillations from the strings are transferred to the instrument body.

With the described manufacturing technique the frets can also be replaced on the fretboard in repair situations.

The invention claimed is:

1. A device for a string instrument comprising:

a) a fretboard;

b) a plurality of frets, wherein said plurality of frets are spaced apart from each other and extend transversely across the fretboard;

c) a plurality of tensioned strings, wherein said plurality of tensioned strings are spaced apart from each other and extend laterally across the fretboard and perpendicular to said plurality of frets, wherein said plurality of tensioned strings may be oscillated to generate a tone, wherein the length of the oscillating part of said plurality of tensioned strings is varied by pressing the strings against a selectable fret for variation of pitch;

wherein each of said plurality of frets comprises straight fret segments located beneath each of said plurality of tensioned strings;

wherein each of said straight fret segment is displaced lengthwise along said plurality of tensioned strings for correction of tone interval individually for each fret.

2. The device according to claim 1, wherein each of said plurality of straight fret segments and each of said plurality of tensioned strings are centered in relation to each other, so that when each of said plurality of tensioned strings are at a rest position, said plurality of tensioned strings extend essentially over the center of the said plurality of straight fret segment.

3. The device according to claim 2, wherein each of said plurality of straight fret segments extend a distance of several millimeters on both sides of the rest position of each of said plurality of tensioned strings.

4. The device according to claim 3, wherein each of said plurality of straight fret segments extend on both sides of the rest position of each of said plurality of tensioned strings to essentially the center of the gaps between adjacent tensioned strings.

5. The device according to claim 1, wherein each of said plurality of straight fret segments within a fret are connected with transition segments, and wherein each of said transition segment are curved and connect adjacent each of said plurality of straight fret segments into one continuous fret.

6. The device according to claim 1, wherein each of said plurality of frets comprise separate, straight fret parts located centrally beneath each of said plurality of tensioned strings.

7. A fretboard for a guitar, mandolin, mandola, banjo, bass or similar string instrument that includes a device according to claim 1.

8. A neck for a guitar, mandolin, mandola, banjo, bass or similar string instrument, that includes a fretboard according to claim 7.

9. A string instrument that includes a neck according to claim 8.

10. The string instrument according to claim 9, wherein said plurality of frets are arranged so that all the thirds of the instrument are pure.

11. The string instrument according to claim 9, wherein said plurality of frets are arranged so that nineteen tones are available within an octave.

12. The string instrument according to claim 9, wherein said plurality of frets are arranged so that thirty-one tones are available within an octave.

13. A method of manufacturing a device wherein:

the positional values for contact points on a fretboard are measured for correct intonation of every note;

the corresponding fret slots, are individually milled at the contact point positions onto the fretboard;

a prototype substance consisting of relatively soft material is pressed into the slots;

casting molds are made around the prototypes; and frets are cast from said casting molds and inserted in respective fret slots.

14. The method according to claim 13, wherein said prototype substance is made of silver.

15. The method according to claim 14, wherein the frets are cast of silicon bronze.

16. The method according to claim 13, wherein the frets are cast of a glass-metal material.

* * * * *